US005489237A

United States Patent [19]

Geib et al.

[11] Patent Number: 5,489,237

[45] Date of Patent: Feb. 6, 1996

[54] COIN QUEUING AND SORTING ARRANGEMENT

[75] Inventors: Joseph J. Geib, Mount Prospect; Douglas U. Mennie, Barrington, both of Ill.

[73] Assignee: Cummins-Allison Corp., Mt. Prospect, Ill.

[21] Appl. No.: 376,771

[22] Filed: Jan. 23, 1995

Related U.S. Application Data

[63] Continuation of Ser. No. 178,658, Jan. 7, 1994, Pat. No. 5,425,669.

[51] Int. Cl.[6] ..... G07D 3/06

[52] U.S. Cl. ..... 453/12; 453/57

[58] Field of Search ..... 453/9, 10, 12, 453/13, 39, 49, 50, 57

[56] References Cited

U.S. PATENT DOCUMENTS

| | | | |
|---|---|---|---|
| 574,528 | 1/1897 | Elder et al. . | |
| 1,390,583 | 9/1921 | Paul . | |
| 1,793,886 | 2/1931 | Weber . | |
| 1,979,659 | 11/1934 | Zierick . | |
| 2,348,936 | 5/1944 | Sprenger . | |
| 2,835,260 | 5/1958 | Buchholz . | |
| 3,016,191 | 1/1962 | Buchholz et al. . | |
| 3,026,982 | 3/1962 | Buchholz et al. . | |
| 3,253,604 | 5/1966 | Read | 453/57 |
| 3,771,538 | 11/1973 | Reis . | |
| 3,837,139 | 9/1974 | Roseberg . | |
| 3,991,778 | 11/1976 | Ushio et al. . | |
| 3,998,237 | 12/1976 | Kressin et al. . | |
| 4,059,122 | 11/1977 | Kinoshita . | |
| 4,086,928 | 5/1978 | Ristvedt et al. . | |
| 4,098,280 | 7/1978 | Ristvedt et al. . | |
| 4,234,003 | 11/1980 | Ristvedt et al. . | |
| 4,275,751 | 6/1981 | Bergman . | |
| 4,444,212 | 4/1984 | Ristvedt et al. . | |
| 4,506,685 | 3/1985 | Childers et al. . | |
| 4,531,531 | 7/1985 | Johnson et al. . | |
| 4,543,969 | 10/1985 | Rasmussen . | |
| 4,549,561 | 10/1985 | Johnson et al. . | |
| 4,557,282 | 12/1985 | Childers et al. . | |

(List continued on next page.)

FOREIGN PATENT DOCUMENTS

| | | | |
|---|---|---|---|
| 2136351 | 1/1972 | Germany | 453/12 |
| 2136657 | 7/1973 | Germany | 453/12 |
| 2515837 | 10/1975 | Germany . | |
| 2829285 | 2/1979 | Germany | 453/12 |
| 3830674 | 3/1990 | Germany | 453/12 |
| 3-63794 | 3/1991 | Japan | 453/57 |

*Primary Examiner*—Michael S. Huppert
*Assistant Examiner*—Scott L. Lowe
*Attorney, Agent, or Firm*—Arnold, White & Durkee

[57] ABSTRACT

A coin queuing and sorting arrangement comprises a coin queuing device and a coin sorting device. The queuing device receives coins of the same or mixed denominations and delivers the coins to an outlet of the queuing device in single file, in a single layer, and with a radially inner edge of each coin positioned at a common reference location. The queuing device includes a rotatable disc having a resilient top surface, and a stationary queuing head having a lower surface positioned parallel to the top surface of the disc and spaced slightly therefrom. The lower surface of the queuing head forms a queuing region for aligning the radially outer edges of coins of all denominations at a common radius, and an exit channel for receiving the queued coins. The exit channel includes a radially inner wall spiralling outwardly relative to the center of rotation of the disc to engage the radially inner edges of the queued coins. The inner wall extends to the outer periphery of the disc for discharging from the disc the queued coins which are advanced along the inner wall. The upper surface of at least an exit end of the exit channel is positioned sufficiently close to the resilient top surface of the disc to press the queued coins down into the resilient top surface as the coins are being discharged from the disc. The coin sorting device, disposed adjacent the queuing device, receives and sorts coins discharged from the disc.

6 Claims, 5 Drawing Sheets

U.S. PATENT DOCUMENTS 4,564,036 1/1986 Ristvedt .
4,564,037 1/1986 Childers et al. .
4,570,655 2/1986 Raterman .
4,586,522 5/1986 Taipale et al. .
4,607,649 8/1986 Taipale et al. .
4,620,559 11/1986 Childers et al. .
4,681,128 7/1987 Ristvedt et al. .
4,731,043 3/1988 Ristvedt et al. .
4,753,624 6/1988 Adams et al. .
4,775,353 10/1988 Childers et al. .
4,775,354 10/1988 Rasmussen et al. .
4,863,414 9/1989 Ristvedt et al. .
4,921,463 5/1990 Primdahl et al. .
4,966,570 10/1990 Ristvedt et al. .
4,988,860 1/1991 Wollet et al. .
5,009,627 4/1991 Rasmussen .
5,011,455 4/1991 Rasmussen .
5,022,889 6/1991 Ristvedt et al. .
5,026,320 6/1991 Rasmussen .
5,106,338 4/1992 Rasmussen et al. .
5,123,873 6/1992 Rasmussen .
5,141,443 8/1992 Rasmussen et al. .
5,195,626 3/1993 Le Hong et al. ..... 453/57 X
5,197,919 3/1993 Geib et al. .
5,295,899 3/1994 Adams et al. ..... 453/10

10
12
18
22
24
26
27
28
29
30
31
32
33
34
35
36
37
38
39
40
41
42
44
50
52a
52b
52c
52d
52e
52f
52g
52h
54
54a
56
60
3
4
5
6
50c
25c
10c
5c
1c
$1
T'a'
T'b'

COIN QUEUING AND SORTING ARRANGEMENT

This application is a continuation of application Ser. No. 08/178,658, filed Jan. 7, 1994, now U.S. Pat. No. 5,425,669.

FIELD OF THE INVENTION

The present invention relates to coin queuing devices for receiving coins of the same or mixed denominations and delivering those coins to a fixed feed station in single file, in a single layer, and with one edge of all the coins positioned at a common reference location. This invention also relates to a coin queuing and sorting arrangement employing a coin sorting device for receiving and sorting the coins discharged from the coin queuing device.

SUMMARY OF THE INVENTION

It is a general object of the present invention to provide an improved coin queuing device for delivering a single file of single-layered coins to a fixed coin feed station with one edge of all the coins aligned with each other.

It is another object of this invention to provide such an improved coin queuing device which delivers the coins with their lower surfaces lying in a common plane, and with the coins moving in a controlled stable manner. It is yet another object of this invention is to provide such an improved coin queuing device which increases the throughput rate of coins processed by the queuing device. It is still another object of this invention to provide such an improved coin queuing device which improves the separation of coins which are stacked on or overlap each other. It is a further object of this invention to provide a coin queuing and sorting arrangement which quickly and accurately delivers coins from the improved coin queuing device to a coin sorting device.

Other objects and advantages of the invention will be apparent from the following detailed description and the accompanying drawings.

In accordance with the present invention, the foregoing objects are realized by providing a coin queuing device for receiving coins of the same or mixed denominations and delivering the coins to an outlet of the queuing device in single file, in a single layer, and with a radially inner edge of each coin positioned at a common reference location. The queuing device includes a rotatable disc having a resilient top surface, and a stationary queuing head having a lower surface positioned parallel to the top surface of the disc and spaced slightly therefrom. The lower surface of the queuing head forms a queuing region for aligning the radially outer edges of coins of all denominations at a common radius, and an exit channel for receiving the queued coins. The exit channel includes a radially inner wall spiralling outwardly relative to the center of rotation of the disc to engage the radially inner edges of the queued coins. The inner wall extends to the outer periphery of the disc for discharging from the disc the queued coins which are advanced along the inner wall. The upper surface of at least an exit end of the exit channel is positioned sufficiently close to the resilient top surface of the disc to press the queued coins down into the resilient top surface as the coins are being discharged from the disc.

In accordance with another aspect of the present invention, a coin sorting device is disposed adjacent the queuing device for receiving and sorting coins discharged from the disc. In a preferred embodiment, the coin sorting device includes a stationary sorting disc for receiving and supporting the discharged coins and a circular guiding wall for guiding the received coins along the periphery of the sorting disc. A plurality of exit apertures, arranged in order of progressively increasing radial width, are formed in the sorting disc adjacent the periphery thereof for receiving coins of different denominations. A rotatable disc is spaced above the sorting disc and includes a resilient pad or ring extending downward from the lower surface thereof for engaging the upper surfaces of coins of all denominations and driving the engaged coins along the guiding wall to the exit apertures.

Figure 2:
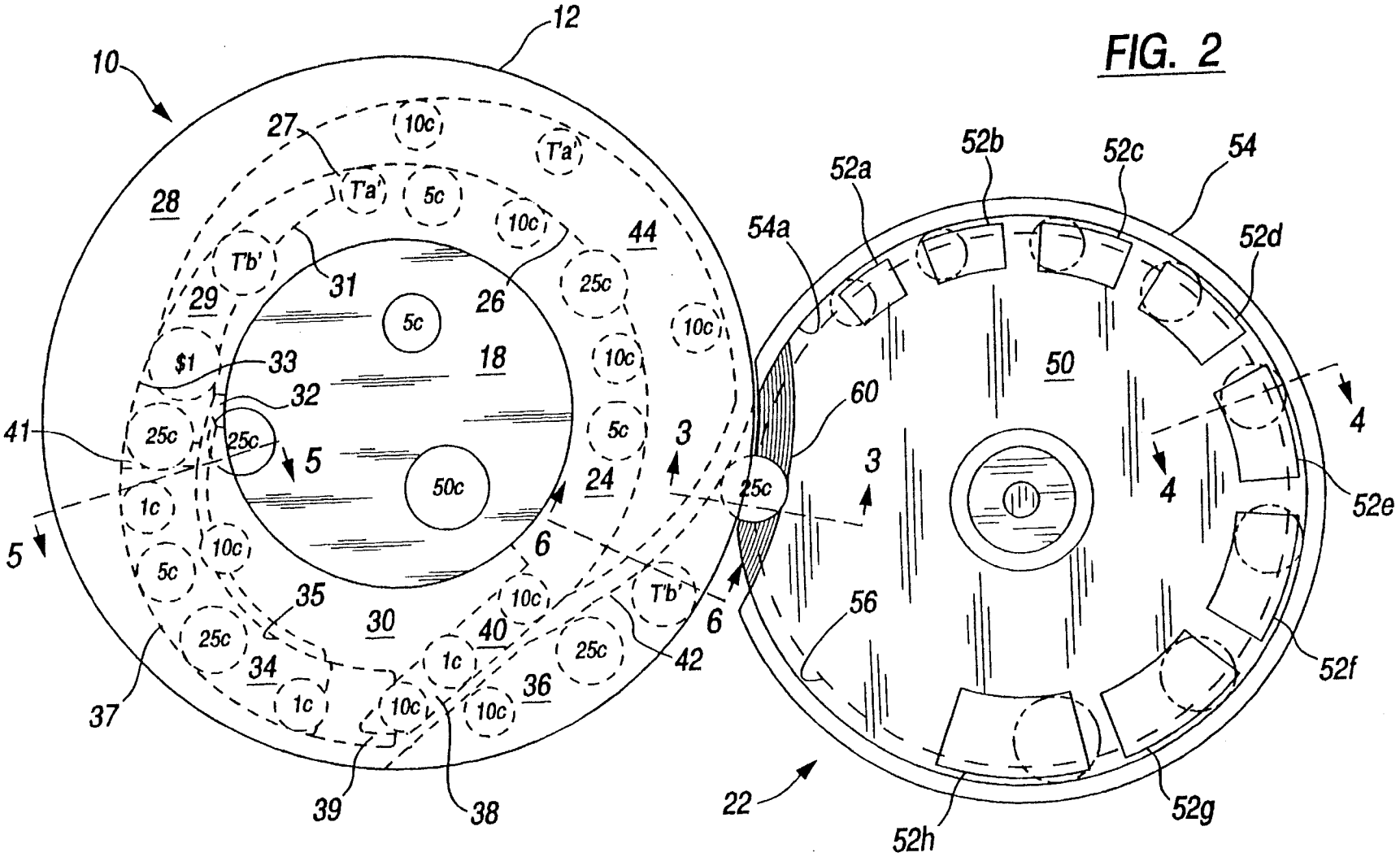
FIG. 2 is a top plan view of the arrangement in FIG. 1.

FIGS. *5a–5c* are enlarged sections taken generally along the line 5—5 in FIG. 2; and FIGS. *6a–6c* are enlarged sections taken generally along the line 6—6 in FIG.

DETAILED DESCRIPTION OF THE PREFERRED EMBODIMENTS

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

Figure 1:
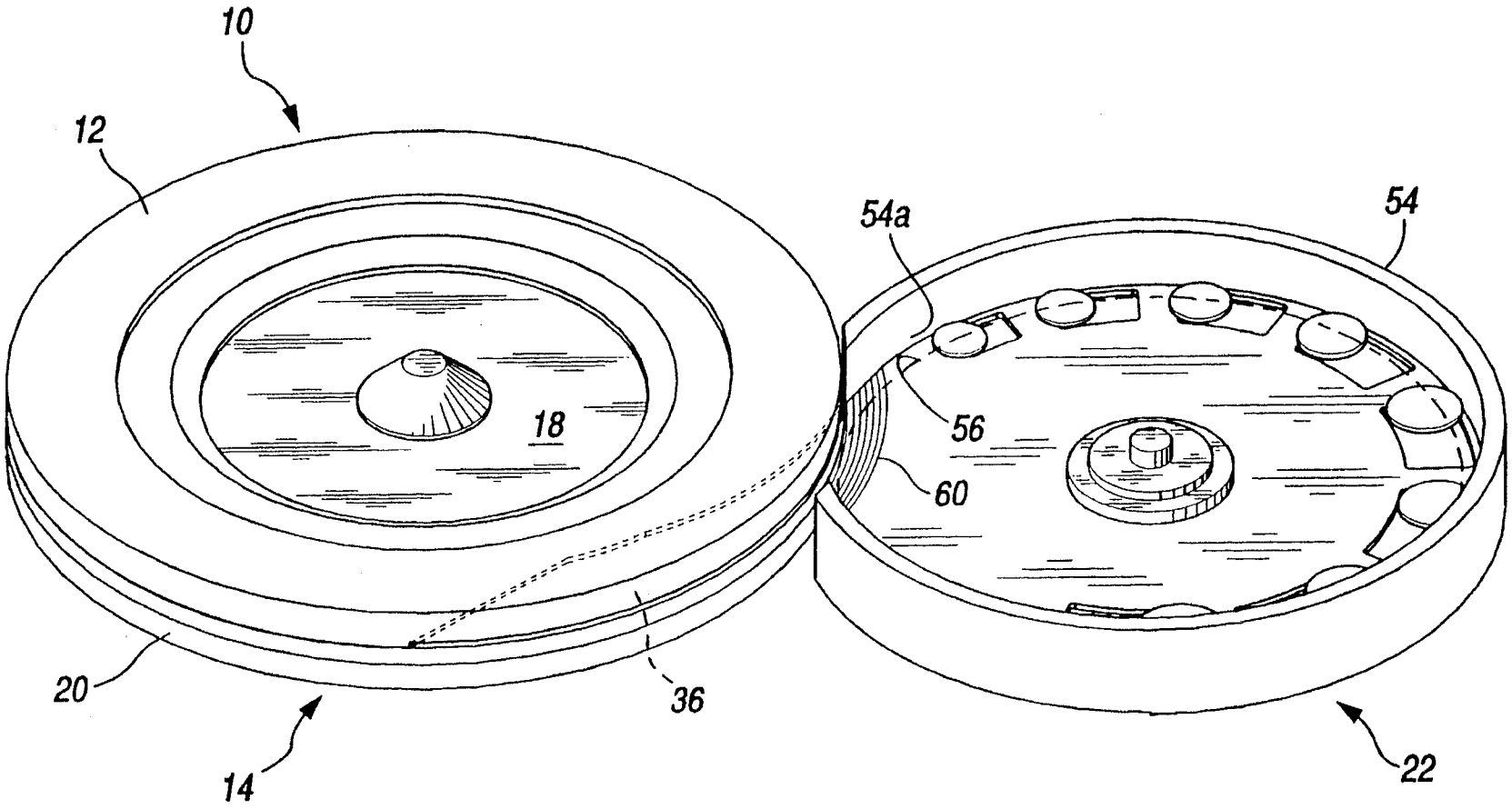
FIG. 1 is perspective view of a coin queuing and sorting arrangement embodying the present invention.

Turning now to the drawings and referring first to FIG. 1, a queuing device 10 includes a hopper which receives coins of mixed denominations and feeds them through a central feed aperture in an annular queuing head or guide plate 12. As the coins pass through the feed aperture, they are deposited on the top surface of a rotatable disc 14. This disc 14 is mounted for rotation on a stub shaft (not shown) driven by an electric motor (not shown). The disc 14 comprises a resilient pad 18, preferably made of a resilient rubber or polymeric material, bonded to the top surface of a solid metal plate 20.

As the disc 14 is rotated (in the counterclockwise direction as viewed in FIG. 2), the coins deposited on the top surface thereof tend to slide outwardly over the surface of the pad 18 due to centrifugal force. As the coins move outwardly, those coins which are lying flat on the pad 18 enter the gap between the pad surface and the queuing head 12 because the underside of the inner periphery of this head 12 is spaced above the pad 18 by a distance which is approximately the same as the thickness of the thickest coin.

As can be seen most clearly in FIG. 2, the outwardly moving coins initially enter an annular recess 24 formed in the underside of the queuing head 12 and extending around a major portion of the inner periphery of the queuing head 12. To permit radial movement of coins entering the recess 24, the recess 24 has an upper surface spaced from the top surface of the pad 18 by a distance which is greater than the thickness of the thickest coin. An upstream outer wall 26 of the recess 24 extends downwardly to the lowermost surface 28 of the queuing head 12, which is preferably spaced from the top surface of the pad 18 by a distance (e.g., 0.010 inch) which is significantly less (e.g., 0.010 inch) than the thickness of the thinnest coin. Consequently, the initial radial movement of the coins is terminated when they engage the upstream outer wall 26 of the recess 24, though the coins continue to move circumferentially along the wall 26 by the rotational movement of the pad 18.

A ramp 27 is formed at the downstream end of the outer wall 26. Coins which are engaged to the wall 26 prior to reaching the ramp 27 are moved by the rotating pad 18 into a channel 29. For example, the coin T'a' at approximately the 12 o'clock position in FIG. 2 will be moved by the rotating pad 18 into the channel 29. However, those coins which are still positioned radially inward from the outer wall 26 prior to reaching the ramp 27 engage a recirculation wall 31, which prevents the coins from entering the channel 29. Instead, the coins are moved along the recirculation wall 31 until they reach a ramp 32 formed at the upstream end of a land 30.

The only portion of the central opening of the queuing head 12 which does not open directly into the recess 24 is that sector of the periphery which is occupied by the land 30. The land 30 has a lower surface which is co-planar with or at a slightly higher elevation than the lowermost surface 28 of the queuing head 12. Coins initially deposited on the top surface of the pad 18 via its central feed aperture do not enter the peripheral sector of the queuing head 12 located beneath the land 30 because the spacing between the land 30 and the pad 18 is slightly less than the thickness of the thinnest coin.

When a coin has only partially entered the recess 24 (i.e., does not engage the ramp 27) and moves along the recirculation wall 31, the coin is recirculated. More specifically, an outer portion of the coin engages the ramp 32 on the leading edge of the land 30. For example, a 25 cent coin at approximately the 9 o'clock position in FIG. 2 is illustrated as having engaged the ramp 32. The ramp 32 presses the outer portion of the coin downwardly into the resilient pad 18 and causes the coin to move downstream in a concentric path beneath the inner edge of the land 30 (i.e., inner periphery of the queuing head 12) with the outer portion of the coin extending beneath the land 30. After reaching the downstream end of the land 30, the coin reenters the recess 24 so that the coin can be moved by the rotating pad 18 through the recess 24 and into the channel 29.

Coins which engage the ramp 27 enter the channel 29, defined by the inner wall 33 and an outer wall 33. The outer wall 31 has a constant radius with respect to the center of the disc 14. Since the distance between the upper surface of the channel 29 and the top surface of the rotating pad 18 is only slightly less than the thickness of the thinnest coin, the coins move downstream in a concentric path through the channel 29. While moving downstream, the coins maintain contact with the outer wall 33. At the downstream end of the channel 29, the coins move into a spiral channel 34 via a ramp 41. The distance between the upper surface of the spiral channel 34 and the top surface of the pad 18 is slightly greater than the thickness of the thickest coin, thereby causing the coins to maintain contact with an outer spiral wall 37 of the channel 34 while moving downstream through the channel 34. The spiral channel 34 guides the coins to an exit channel 36. At the downstream end of the outer spiral wall 37, i.e., at the point where the spiral wall 37 reaches its maximum radius, the coins engage a ramp 39 which presses the coins downwardly into the resilient surface of the rotating pad 18. The outer edges of coins which are against the outer wall 37 have a common radial position and are ready for passage into the exit channel 36. Coins whose radially outer edges are not engaged by the ramp 39 engage a wall 38 of a recycling channel 40 which guides such coins back into the entry recess 24 for recirculation.

Figure 5A:
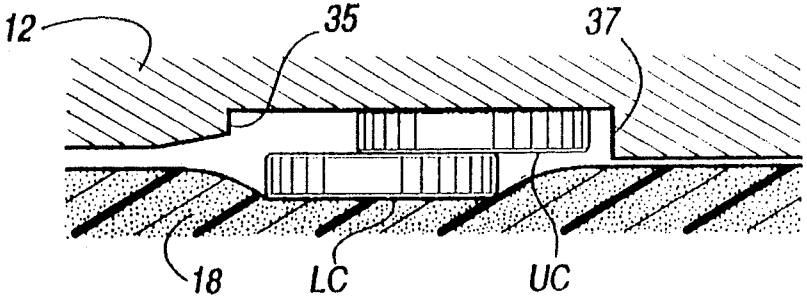
Figure 5B:
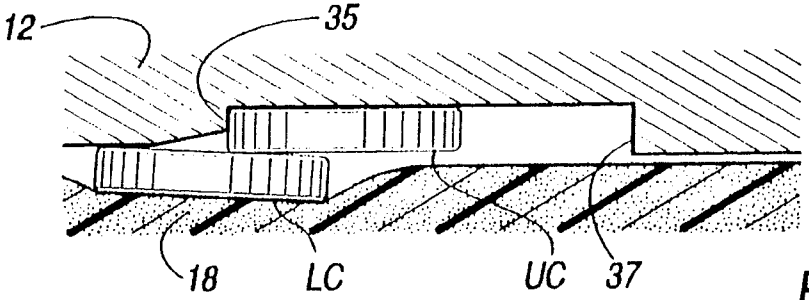
Figure 5C:
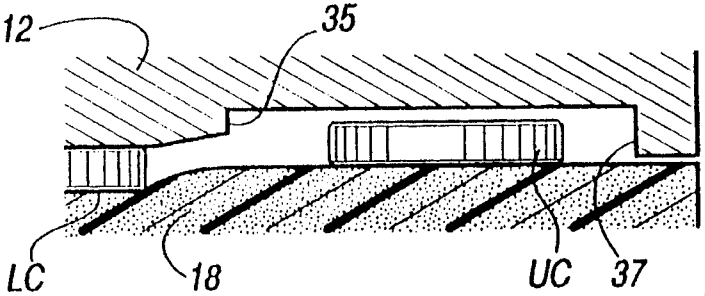

The spiral channel 34 strips apart most stacked or shingled coins entering the channel 34 from the channel 29 (FIGS. 5*a*–5*c* ). While a pair of stacked or shingled coins are moving through the channel 29, the combined thickness of the stacked or shingled coins is usually great enough to cause the lower coin in that pair to be pressed into the resilient pad 18. As a result, that pair of coins will be rotated concentrically with the disc through the channel 29 and into the channel 34. Because the inner wall 35 of the channel 34 spirals outwardly, the upper coin will eventually engage the upper vertical portion of the inner wall 35, and the lower coin will pass beneath the wall 35 and beneath the land 30. This lower coin will then be rotated concentrically with the disc beneath the land 30 and recirculated back to the entry recess 24 of the queuing head 12. If, however, the combined thickness of the stacked or shingled coins is not great enough to cause the lower coin in the pair to be pressed into the pad 18 (e.g., two very thin foreign coins), the coins are stripped apart in the exit channel 36 as described below.

The exit channel 36 causes all coins which enter the channel 36, regardless of different thicknesses and/or diameters, to exit the channel 36 with a common edge (the inner edges of all coins) aligned at the same radial position so that the opposite (outer) edges of the coins can be used for sorting in the circular sorting device 22.

The upper surface of the channel 36 is recessed slightly from the lowermost surface 28 of the queuing head 12 so that the inner wall 42 of the channel 36 forms a coin-guiding wall. This upper surface, however, is close enough to the pad surface to press coins of all denominations into the resilient pad 18.

As coins are advanced through the exit channel 36, they follow a path that is concentric with the center of rotation of the disc 14 because the coins of all denominations are continuously pressed firmly into the resilient disc surface. Because the coins are securely captured by this pressing engagement, there is no need for an outer wall to contain coins within the exit channel 36. The inner edges of coins of all denominations eventually engage the inner wall 42, which then guides the coins outwardly to the periphery of the disc. As can be seen in FIG. 2, a downstream section of the inner wall 42 of the exit channel 36 forms the final gaging wall for the inner edges of the coins as the coins exit the queuing head 12. As the inner wall 42 extends toward the periphery of the sorting head 12, the inner wall 42 gradually curves in the direction of rotation of the disc 14 (curving away from the radial direction), as opposed to curving against the direction of rotation of the disc 14 and toward the radial direction. In other words, the angle between (1) an imaginary tangent to the inner wall 42 at its upstream end and (2) an imaginary line drawn between the upstream end and the downstream end of the inner wall 42 is greater than zero, where positive angles are defined to be angles in the direction of rotation of the disc 14.

Figure 6A:
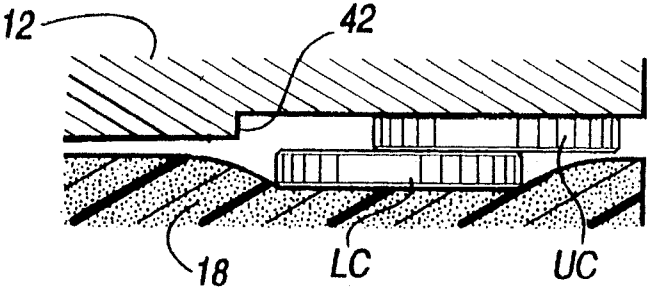
Figure 6B:
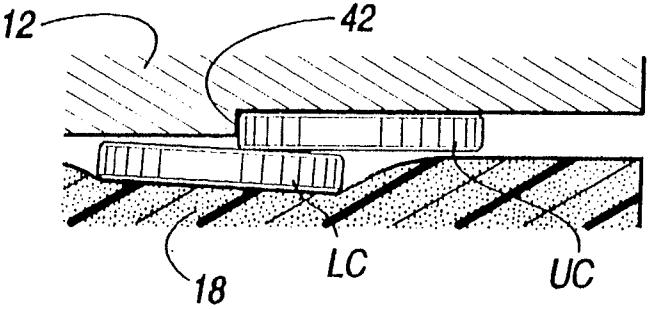
Figure 6C:
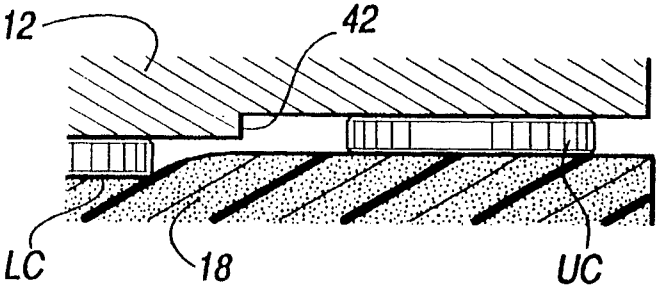

The exit channel 36 strips apart stacked or shingled coins which are not stripped apart by the spiral channel 34 (FIGS. 6*a*–6*c*). The combined thickness of any pair of stacked or shingled coins is great enough to cause the lower coin in that pair to be pressed into the resilient pad 18. Consequently, that pair of coins will be rotated concentrically with the disc. Because the inner wall 42 of the exit channel 36 spirals outwardly, the upper coin will eventually engage the upper vertical portion of the inner wall 42, and the lower coin will pass beneath the wall 42. This lower coin will be passed into a recirculating channel 44, which functions like the entry recess 24 to guide the coin downstream into the channel 29.

In the preferred embodiment, the queuing device 10 is used to feed the circular sorting device 22. Thus, in FIG. 2 the coins are sorted by passing the coins over a series of apertures formed around the periphery of a stationary sorting disc 50. The apertures 52*a*–52*h* are of progressively increasing radial width so that the small coins are removed before the larger coins. The outboard edges of all the apertures 52*a*–5*h* are spaced slightly away from a cylindrical wall 54 extending around the outer periphery of the disc 50 for guiding the outer edges of the coins as the coins are advanced over successive apertures. The disc surface between the wall 54 and the outer edges of the apertures 52*a*–5*h* provides a continuous support for the outer portions of the coins. The inner portions of the coins are also supported by the disc 50 until each coin reaches its aperture, at which point the inner edge of the coin tilts downwardly and the coin drops through its aperture. Before reaching the aperture 52*a*, the coins are radially moved slightly inward by the wall 54 to insure accurate positioning of the coins after they are transferred from the queuing device 10 to the circular sorting device 22.

Figure 4:
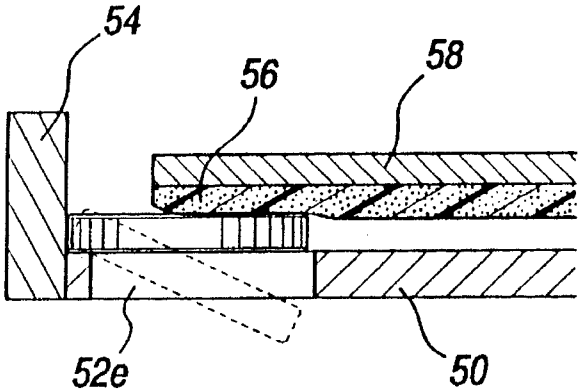
FIG. 4 is an enlarged section taken generally along the line 4—4 in FIG. 2.
Figure 3:
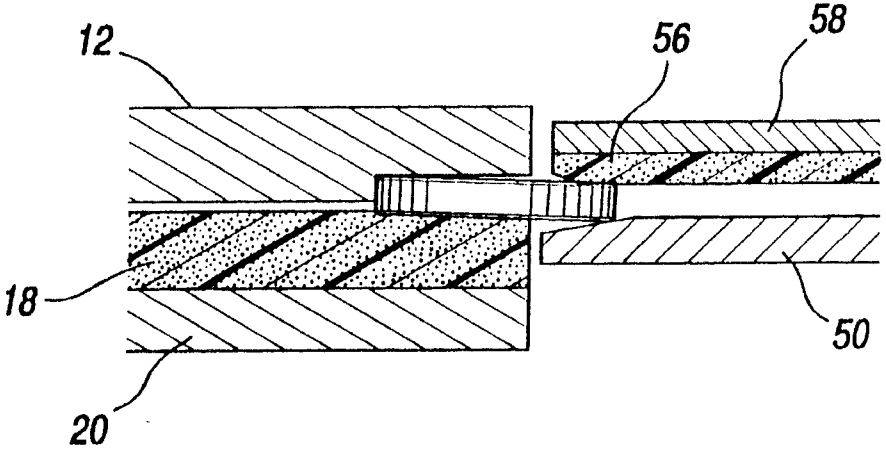
FIG. 3 is an enlarged section taken generally along the line 3—3 in FIG. 2.

To advance the coins along the series of apertures 52*a*–5*h* , the upper surfaces of the coins are engaged by a resilient rubber pad 56 attached to the lower surface of a rotating disc 58 (FIGS. 3 and 4). As viewed in FIG. 2, the disc 58 is rotated clockwise. Alternatively, the pad 56 may be substituted with a resilient rubber ring attached to the outer periphery of the lower surface of the rotating disc 58. The lower surface of the rubber pad 56 is spaced sufficiently close to the upper surface of the disc 50 that the rubber pad 56 presses coins of all denominations, regardless of coin thickness, firmly down against the surface of the disc 50 while advancing the coins concentrically around the peripheral margin of the disc 50. Consequently, when a coin is positioned over the particular aperture 52 through which that coin is to be discharged, the resilient rubber pad 56 presses the coin down through the aperture (FIG. 4).

As can be seen in FIG. 2, an arc-shaped section of the stationary disc 50 is cut away at a location adjacent the queuing device 10 to permit a smooth transition between the exit channel 36 and sorting device 22. Because of this cut-away section, coins which are advanced along the exit channel 36 formed by the queuing head 12 are actually engaged by the rubber pad 56 before the coins completely leave the disc 14. As each coin approaches the periphery of the disc 14, the outer portion of the coin begins to project beyond the disc periphery. This projection starts earlier for large-diameter coins than for small-diameter coins. As can be seen in FIG. 3, the portion of a coin that projects beyond the disc 14 eventually overlaps the support surface formed by the stationary sorting disc 50. When a coin overlaps the disc 50, the coin also intercepts the path of the rubber pad 56. The outer portion of the coin is engaged by the rubber pad 56 (FIG. 3).

Each coin is positioned partly within the queuing device 10 and partly within the sorting device 22 for a brief interval before the coin is actually transferred from the queuing device 10 to the sorting device 22. As can be seen in FIG. 2, the coin-guiding inner wall 42 of the exit channel 36 in the queuing head 12 begins to follow an extension of the inner surface 54*a* of the wall 54 at the exit end of the queuing head 12, so that the inboard edges of the coins on the disc 14 (which become the outboard edges of the coins when they are transferred to the disc 50) are smoothly guided by the inner wall 42 of the exit channel 36 and then the inner surface 54*a* of the wall 54 as the coins are transferred from the disc 14 to the disc 50.

As previously stated, the exit channel 36 has such a depth that the coins of all denominations are pressed firmly down into the resilient pad 18. The coins remain so pressed until they leave the queuing device 10. This firm pressing of the coins into the pad 18 ensures that the coins remain captured during the transfer process, i.e., ensuring that the coins do not fly off the disc 14 by centrifugal force before they are transferred completely to the stationary disc 50 of the sorting device 22.

To facilitate the transfer of coins from the disc 14 to the disc 50, the outer edge portion of the top surface of the disc 50 is tapered at 60 (see FIG. 3). Thus, even though the coins are pressed into the pad 18, the coins do not catch on the edge of the disc 50 during the coin transfer.

What is claimed is:

1. A coin queuing and sorting arrangement, comprising:

a coin queuing device including a rotatable disc having a resilient top surface for receiving a plurality of coins thereon, and a stationary queuing head having a lower surface positioned generally parallel to and opposing said resilient top surface of said rotatable disc and spaced slightly therefrom, said lower surface of said queuing head having formed therein at least one referencing channel for aligning edges of the coins on said top surface of said rotatable disc at a common radius as the coins are moved by said rotatable disc through said referencing channel, said lower surface of said queuing head further having formed therein an exit channel for receiving the queued coins, said exit channel including a radially inner wall extending to a periphery of said rotatable disc for discharging from said rotatable disc the queued coins which are advanced through said exit channel, the queued coins bearing against said radially inner wall as the queued coins exit said exit channel; and a coin sorting device, disposed adjacent said queuing device, for receiving and sorting coins discharged from said rotatable disc.

2. The arrangement of claim 1, wherein said coin sorter device includes a coin-driving member having a resilient surface and a stationary coin-guiding member having a coin-guiding surface opposing said resilient surface of said coin-driving member, said coin-guiding surface being positioned generally parallel to said resilient surface of said coin-driving member, said resilient surface of said coin-driving member constructed and arranged to move the coins along said coin-guiding surface of said coin-guiding member, said coin-guiding surface forming a plurality of exit stations for selectively allowing exiting of the coins based upon their respective diameters.

3. A coin queuing and sorting arrangement, comprising:

a coin queuing device including a rotatable disc having a resilient top surface for receiving a plurality of coins thereon, and a stationary queuing head having a lower surface positioned generally parallel to and opposing said resilient top surface of said rotatable disc and spaced slightly therefrom, said lower surface of said queuing head having formed therein at least one referencing channel for aligning edges of the coins on said top surface of said rotatable disc at a common radius as the coins are moved by said rotatable disc through said referencing channel, said lower surface of said queuing head further having formed therein an exit channel for receiving the queued coins, said exit channel including a radially inner wall extending to a periphery of said rotatable disc for discharging from said rotatable disc the queued coins which are advanced through said exit channel, said radially inner wall engaging radially inner edges of the queued coins as the queued coins exit said exit channel; and a coin sorting device, disposed adjacent said queuing device, for receiving and sorting coins discharged from said rotatable disc.

4. The arrangement of claim 3, wherein said coin sorter device includes a coin-driving member having a resilient surface and a stationary coin-guiding member having a coin-guiding surface opposing said resilient surface of said coin-driving member, said coin-guiding surface being positioned generally parallel to said resilient surface of said coin-driving member, said resilient surface of said coin-driving member constructed and arranged to move the coins along said coin-guiding surface of said coin-guiding member, said coin-guiding surface forming a plurality of exit stations for selectively allowing exiting of the coins based upon their respective diameters.

5. A coin queuing and sorting arrangement, comprising:

a coin queuing device including a rotatable disc having a resilient top surface for receiving a plurality of coins thereon, and a stationary queuing head having a lower surface positioned generally parallel to and opposing said resilient top surface of said rotatable disc and spaced slightly therefrom, said lower surface of said queuing head having formed therein at least one referencing channel for aligning edges of the coins on said top surface of said rotatable disc at a common radius as the coins are moved by said rotatable disc through said referencing channel, said lower surface of said queuing head further having formed therein an exit channel for receiving the queued coins, said exit channel including a radially inner wall extending to a periphery of said rotatable disc for discharging from said rotatable disc the queued coins which are advanced through said exit channel, said radially inner wall and a substantially circular periphery of said queuing head gradually merging toward each other as said radially inner wall extends toward the periphery of said queuing head; and a coin sorting device, disposed adjacent said queuing device, for receiving and sorting coins discharged from said rotatable disc.

6. The arrangement of claim 5, wherein said coin sorter device includes a coin-driving member having a resilient surface and a stationary coin-guiding member having a coin-guiding surface opposing said resilient surface of said coin-driving member, said coin-guiding surface being positioned generally parallel to said resilient surface of said coin-driving member, said resilient surface of said coin-driving member constructed and arranged to move the coins along said coin-guiding surface of said coin-guiding member, said coin-guiding surface forming a plurality of exit stations for selectively allowing exiting of the coins based upon their respective diameters.

* * * * *